US008823549B1

(12) United States Patent
Moone

(10) Patent No.: US 8,823,549 B1
(45) Date of Patent: Sep. 2, 2014

(54) MOTION DETECTING TRAFFIC CONE ASSEMBLY

(71) Applicant: Darryl A. Moone, Gainsville, VA (US)

(72) Inventor: Darryl A. Moone, Gainsville, VA (US)

( * ) Notice: Subject to any disclaimer, the term of this patent is extended or adjusted under 35 U.S.C. 154(b) by 180 days.

(21) Appl. No.: 13/677,494

(22) Filed: Nov. 15, 2012

(51) Int. Cl.
*G08G 1/095* (2006.01)
*G08G 1/01* (2006.01)

(52) U.S. Cl.
CPC ..... *G08G 1/01* (2013.01)
USPC ..... 340/908; 340/908.1; 340/907; 362/158; 362/183; 116/63 C; 116/63 P

(58) Field of Classification Search
USPC ..... 340/908, 908.1, 907, 573.1, 815.4, 340/815.45; 362/158, 183, 276, 800; 404/6, 404/7, 9; 116/63 C, 63 P, 209
See application file for complete search history.

(56) References Cited

U.S. PATENT DOCUMENTS

D411,810 S 7/1999 Stockman
6,971,329 B1 12/2005 Stewart
7,230,546 B1 6/2007 Nelson et al.
7,538,688 B1 * 5/2009 Stewart ..... 340/908
7,905,622 B2 3/2011 Nielson et al.
2003/0132852 A1 7/2003 Povey et al.
2006/0266274 A1 11/2006 Kuo
2010/0265699 A1 * 10/2010 Nielson et al. ..... 362/158

FOREIGN PATENT DOCUMENTS

WO 2009032859 * 3/2009

* cited by examiner

*Primary Examiner* — Hung T Nguyen

(57) ABSTRACT

A motion detecting traffic cone assembly includes a cone that may be positioned on a support surface such that the cone is visible to an observer. A processor is coupled to the cone. A motion detector is coupled to the cone so the motion detector may detect the observer. The motion detector is operationally coupled to the processor so the motion detector may selectivel actuate the processor. A light emitter is coupled to the cone. The light emitter is operationally coupled to the processor so the processor may selectively actuate the light emitter. An alarm is coupled to the cone. The alarm is operationally coupled to the processor so the processor may selectively actuate the alarm. A speaker is coupled to the cone. The speaker is operationally coupled to the alarm so the alarm may selectively actuate the speaker. A control panel is coupled to the cone. The control panel is operationally coupled to the processor.

17 Claims, 5 Drawing Sheets

MOTION DETECTING TRAFFIC CONE ASSEMBLY

BACKGROUND OF THE DISCLOSURE

Field of the Disclosure

The disclosure relates to motion detecting traffic cone devices and more particularly pertains to a new motion detecting traffic cone device for alerting an observer to a hazard.

SUMMARY OF THE DISCLOSURE

An embodiment of the disclosure meets the needs presented above by generally comprising a cone that may be positioned on a support surface such that the cone is visible to an observer. A processor is coupled to the cone. A motion detector is coupled to the cone so the motion detector may detect the observer. The motion detector is operationally coupled to the processor so the motion detector may selectivel actuate the processor. A light emitter is coupled to the cone. The light emitter is operationally coupled to the processor so the processor may selectively actuate the light emitter. An alarm is coupled to the cone. The alarm is operationally coupled to the processor so the processor may selectively actuate the alarm. A speaker is coupled to the cone. The speaker is operationally coupled to the alarm so the alarm may selectively actuate the speaker. A control panel is coupled to the cone. The control panel is operationally coupled to the processor.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
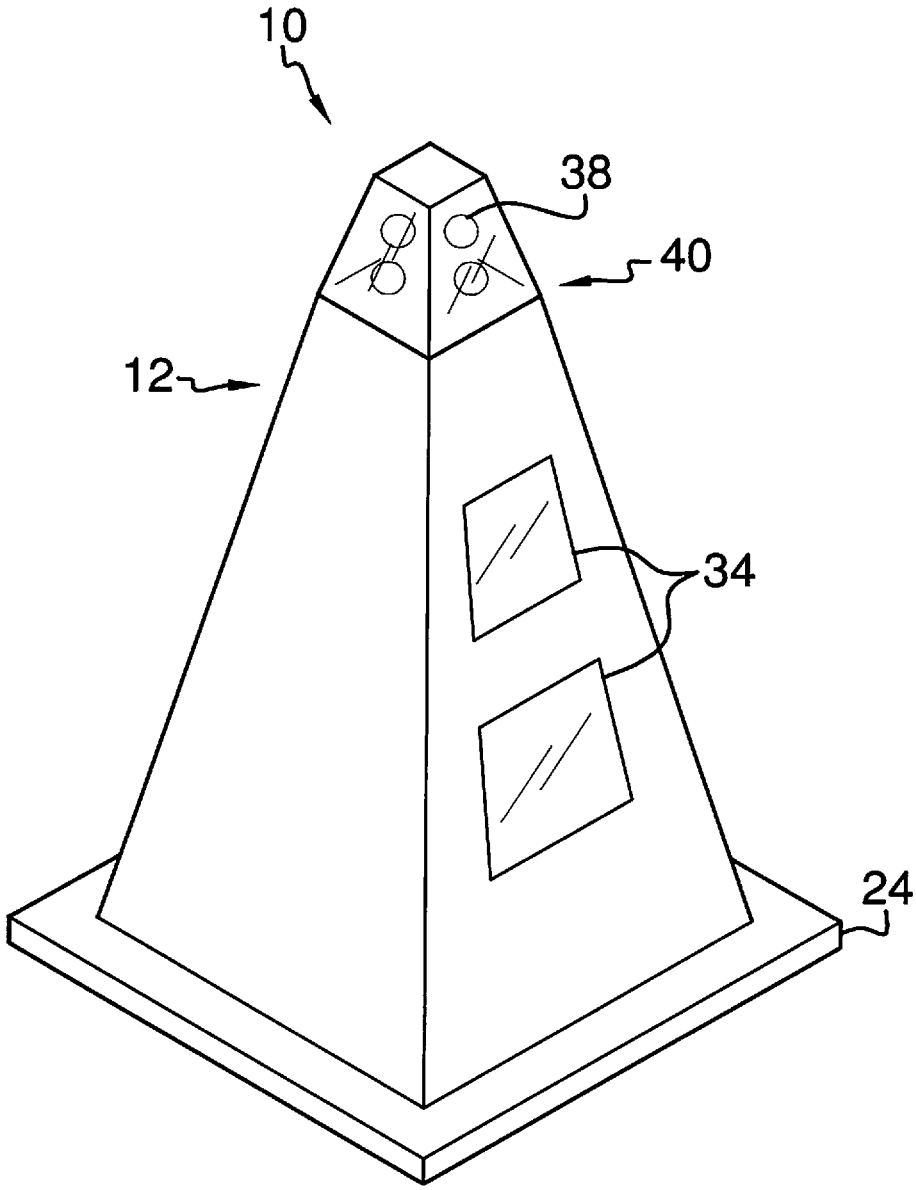
FIG. 1 is a perspective view of a motion detecting traffic cone assembly according to an embodiment of the disclosure.
Figure 2:
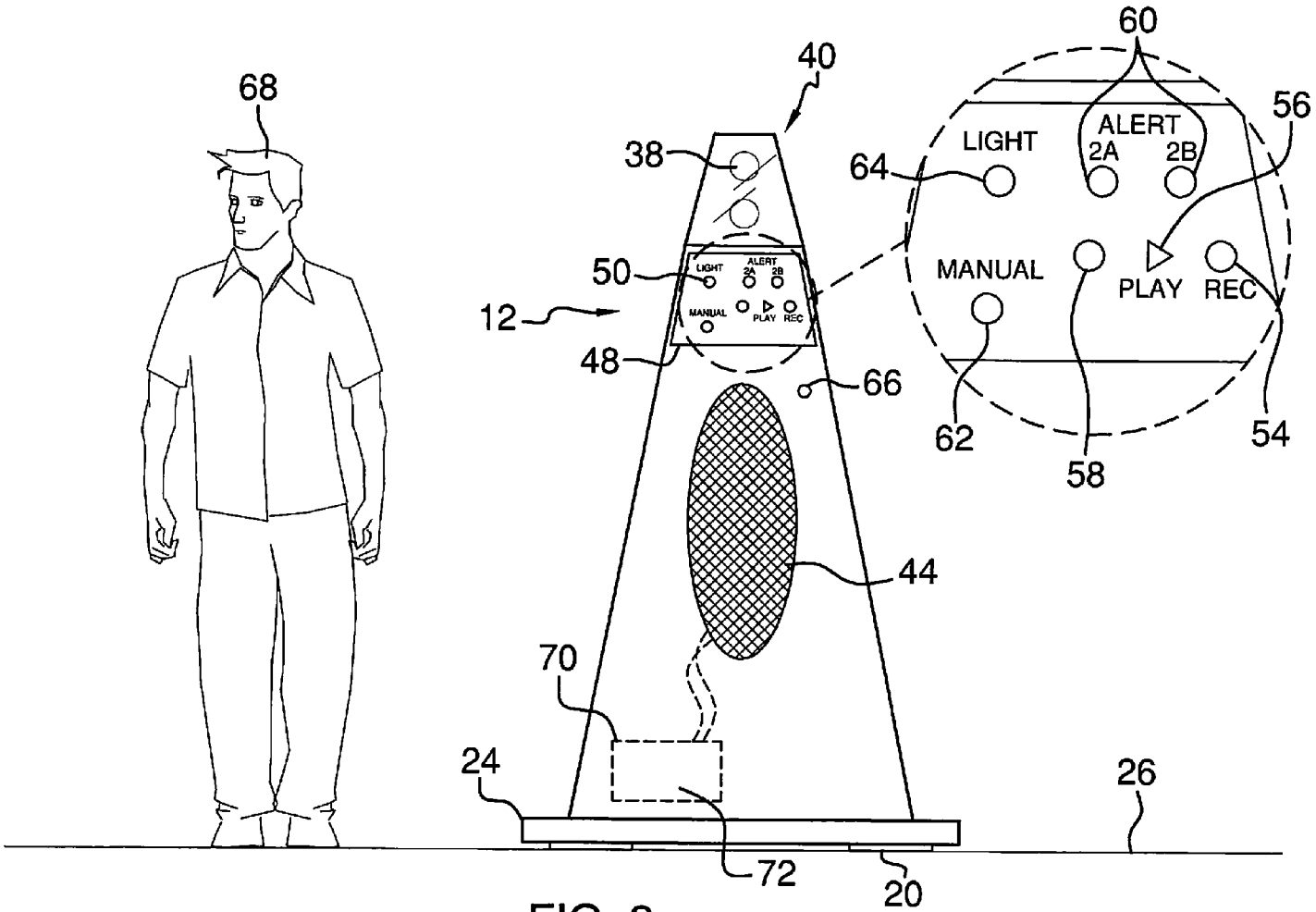
FIG. 2 is a back view of an embodiment of the disclosure.
Figure 3:
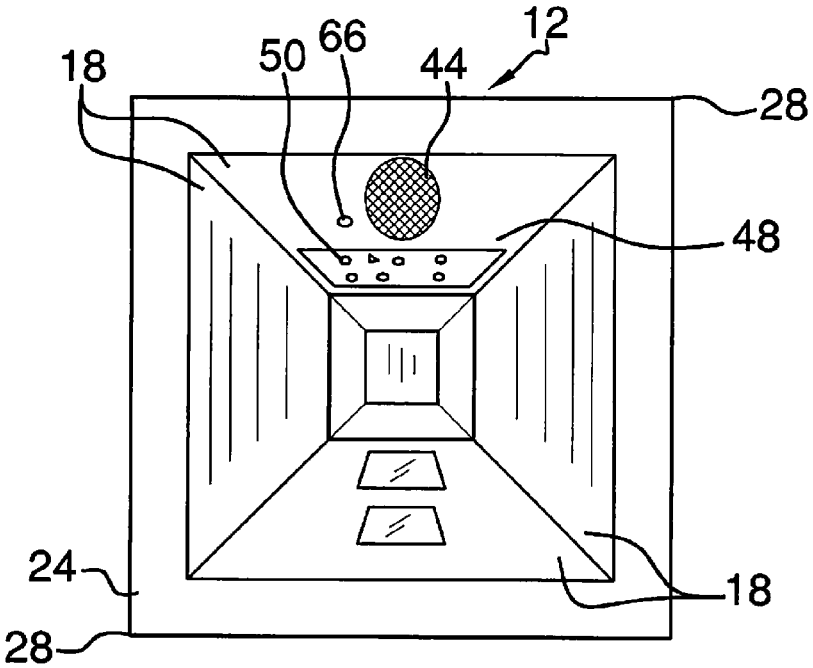
FIG. 3 is a top view of an embodiment of the disclosure.
Figure 4:
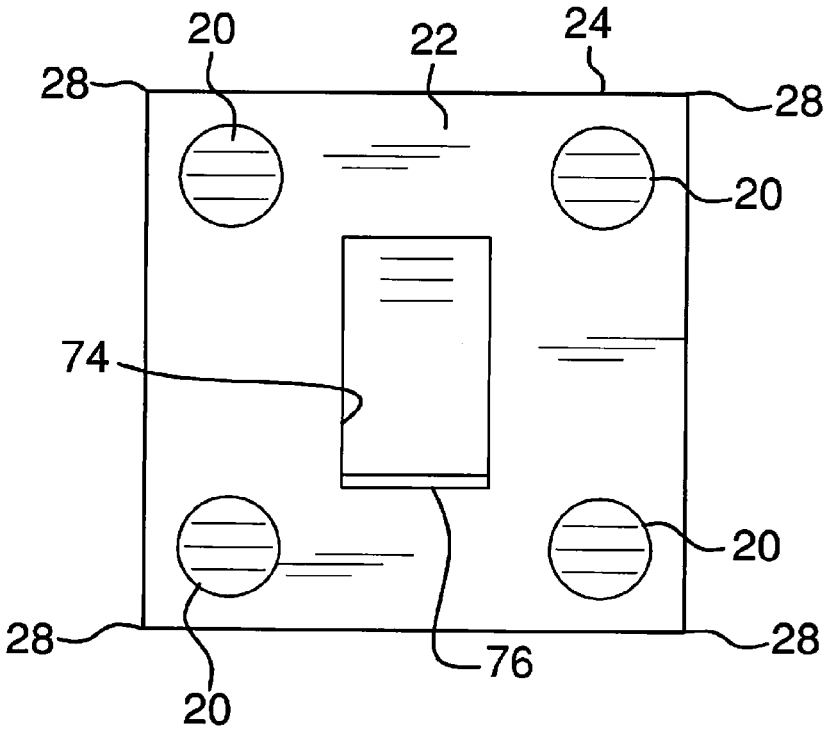
FIG. 4 is a bottom view of an embodiment of the disclosure.
Figure 5:
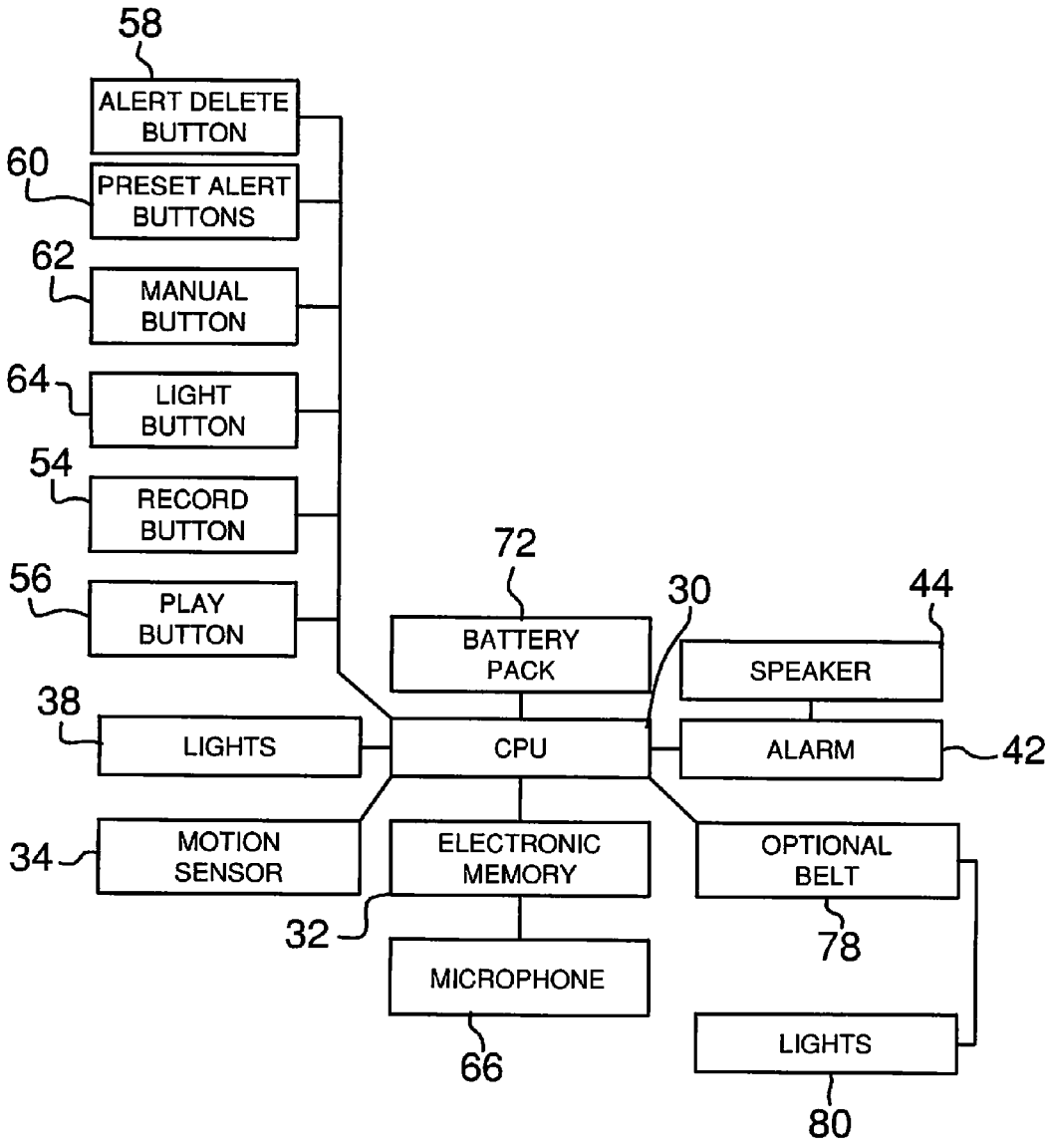
FIG. 5 is a schematic view of an embodiment of the disclosure.
Figure 6:
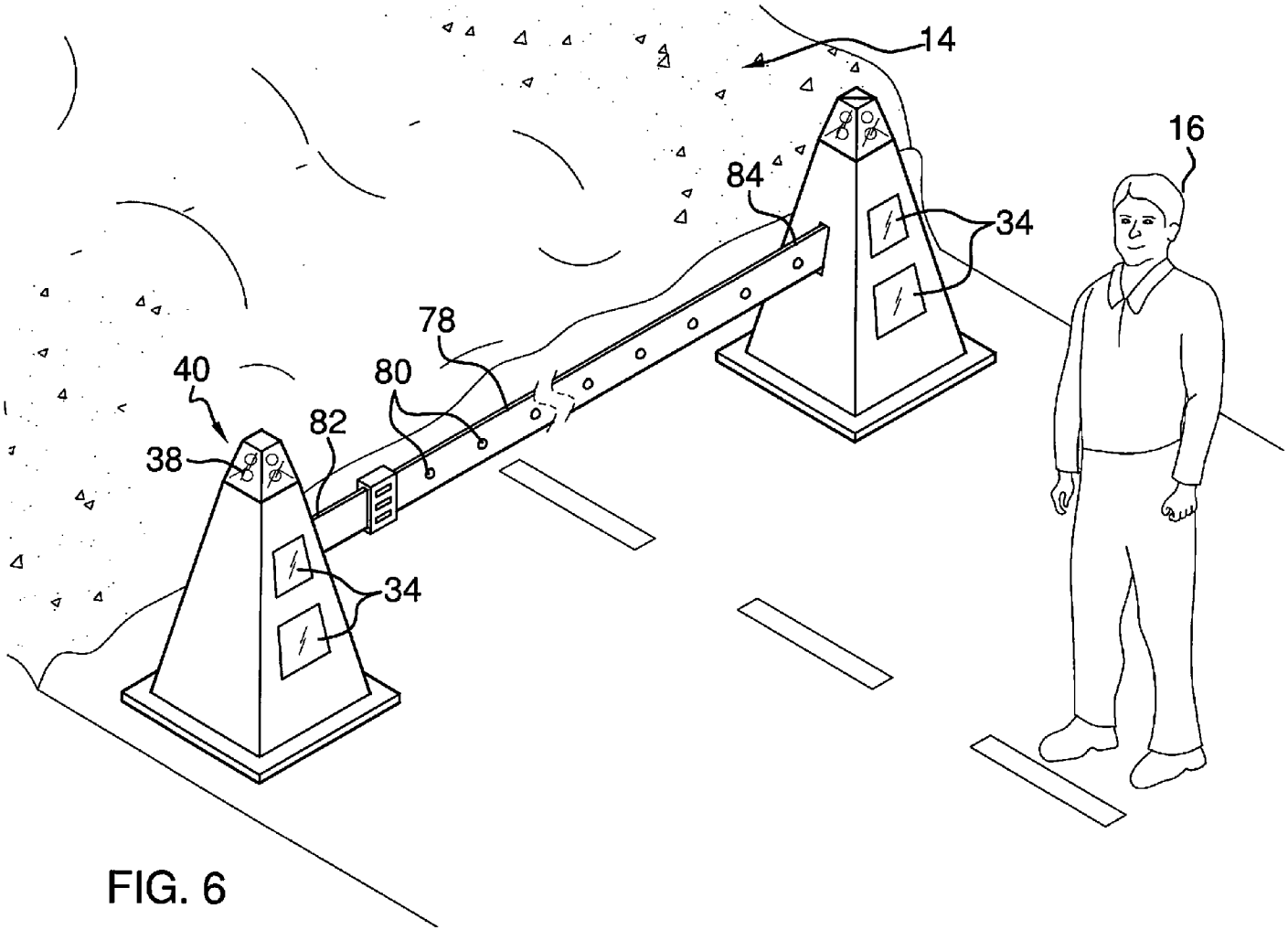
FIG. 6 is a front perspective view of an embodiment of the disclosure.

With reference now to the drawings, and in particular to FIGS. 1 through 6 thereof, a new motion detecting traffic cone device embodying the principles and concepts of an embodiment of the disclosure and generally designated by the reference numeral 10 will be described.

As best illustrated in FIGS. 1 through 6, the motion detecting traffic cone assembly 10 generally comprises a cone 12 that is positionable proximate a hazard 14 so the cone 12 may alert an observer 16 to the hazard 14. The hazard 14 may comprise a construction area. The cone 12 has a plurality of sides 18 so the cone 12 has a pyramidal shape. A foot 20 is coupled to a bottom side 22 of a base 24 of the cone 12. The foot 20 may abut a support surface 26 so the cone 12 is supported above the support surface 26. The foot 20 is one of a plurality of feet 20. Each of the plurality of feet 20 is positioned proximate an associated one of four corners 28 of the base 24 of the cone 12.

A processor 30 is coupled to the cone 12. An electronic memory 32 is coupled to the cone 12 and the electronic memory 32 is electrically coupled to the processor 30. A motion detector 34 is coupled to a front side 36 of the cone 12 so the motion detector 34 faces away from the hazard 14. The motion detector 34 may have an operational range between 1.5 m and 3 m so the motion detector may 34 detect the observer 16. The motion detector 34 is electrically coupled to the processor 30 so the motion detector 34 may selectively actuate the processor 30 when the motion detector 34 detects the observer 16.

A light emitter 38 is coupled to a top 40 of the cone 12 so the light emitter 38 comprises a frustum of the cone 12. The light emitter 38 is electrically coupled to the processor 30 so the processor 30 may selectively actuate the light emitter 38. The light emitter 38 may emit a beam of light so the light emitter 38 may alert the observer 16 to the hazard 14. The light emitter 38 may comprise an LED of any conventional design. The light emitter 38 is one of a plurality of light emitters 38. The plurality of light emitters 38 is evenly distributed around the plurality of sides 18 of the cone 12.

An alarm 42 is coupled to the cone 12 and the alarm 42 is electrically coupled to the processor 30 so the alarm 42 may selectively generate an alarm signal. A speaker 44 is coupled to a rear side 46 of the cone 12 so the speaker 44 may emit an audible warning. The speaker 44 is electrically coupled to the alarm 42 so the speaker 44 may emit the audible warning when the alarm 42 generates the alarm signal. The speaker 44 may have an operational wattage between 25 watts and 50 watts and the speaker 44 may generate a sound level between 80 dB and 100 dB.

A control panel 48 is coupled to the rear side 46 of the cone 12 proximate the top 40 of the cone 12. The control panel 48 is electrically coupled to the processor 30 so the control panel 48 may selectively actuate the processor 30. An actuator 50 is coupled to a front 52 of the control panel 48. The actuator 50 is electrically coupled to the processor 30 so the actuator 50 may selectively actuate the processor 30. The actuator 50 is one of a plurality of actuators 50. Each of the plurality of actuators 50 performs a selected one of a plurality of command functions. The plurality of actuators 50 may include a record actuator 54, a play actuator 56, an delete alert actuator 58, a preset alert actuator 60, a manual actuator 62 and a light actuator 64.

A microphone 66 is coupled to the cone 12. The microphone 66 is electrically coupled to the electronic memory 32. The microphone 66 detects a user's voice so the electronic memory 32 may record the user's voice. The user 68 may create a custom alarm signal for the alarm 42.

A power supply 70 is coupled to the cone 12. The power supply 70 is electrically coupled to the processor 30. The power supply 70 may comprise at least one battery 72. The battery 72 is positioned within a battery space 74 extending upwardly into the base 24 of the cone 12. A battery cover 76 is provided that may cover the battery space 74.

A belt 78 is provided that may be coupled between a pair of the cones 12 so belt 78 is placed in electrical communication with the processor 30 in each of the pair of cones 12. A plurality of belt light emitters 80 is coupled to the belt 78. The plurality of belt light emitters 80 is evenly distributed between a first end 82 and a second end 84 of the belt 78. The plurality of belt light emitters 80 is electrically coupled to each of the processors 30 when the belt 78 is coupled between the pair of cones 12. The plurality of belt light emitters 80 may emit a beam of light to alert the observer 16 to the hazard 14. The belt 78 may have a length between 3 m and 4 m.

In use, the cone 12 may be positioned proximate the hazard 14. The user 68 may record a custom alarm by actuating the record actuator 54 and then speaking into the microphone 66. The custom alarm may be selected as the default alarm or one of a pair of preset alarms may be selected. The alarm 42 and the light emitter 38 may be actuated by the motion detector 34 simultaneously or independently. The belt 78 may be coupled to a pair of cones 12 in order to protect a larger area.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A motion detecting traffic cone assembly comprising:

a cone configured to be positioned on a support surface such that said cone is visible to an observer;

a processor coupled to said cone;

a motion detector coupled to said cone wherein said motion detector detects the observer, said motion detector being operationally coupled to said processor wherein said motion detector selectively actuates said processor;

a light emitter coupled to said cone, said light emitter being operationally coupled to said processor wherein said processor selectively actuates said light emitter;

an alarm coupled to said cone, said alarm being operationally coupled to said processor wherein said processor selectively actuates said alarm;

a speaker coupled to said cone, said speaker being operationally coupled to said alarm wherein said alarm selectively actuates said speaker; and a control panel coupled to said cone, said control panel being operationally coupled to said processor.

2. The assembly according to claim 1, further comprising said cone being positionable proximate a hazard wherein said cone is configured to alert the observer to the hazard.

3. The assembly according to claim 2, further comprising said cone having a plurality of sides wherein said cone has a pyramidal shape.

4. The assembly according to claim 1, further comprising said motion detector being coupled to a front side of said cone wherein said motion detector faces away from a hazard.

5. The assembly according to claim 4, further comprising said motion detector being electrically coupled to said processor.

6. The assembly according to claim 1, further comprising said light emitter being coupled to a top of said cone wherein said light emitter comprises a frustum of said cone.

7. The assembly according to claim 6, further comprising said light emitter being electrically coupled to said processor.

8. The assembly according to claim 7, further comprising said light emitter emitting a beam of light wherein said light emitter is configured to alert the observer of the hazard.

9. The assembly according to claim 8, further including said light emitter being one of a plurality of said light emitters, said plurality of light emitters being evenly distributed around a plurality of sides of said cone.

10. The assembly according to claim 1, further comprising said alarm being electrically coupled to said processor wherein said alarm selectively generates an alarm signal.

11. The assembly according to claim 1, further comprising said speaker being coupled to a rear side of said cone wherein said speaker emits an audible warning.

12. The assembly according to claim 11, further comprising said speaker being electrically coupled to said alarm wherein said speaker emits the audible warning when said alarm generates an alarm signal.

13. The assembly according to claim 1, further comprising said control panel being coupled to a rear side of said cone proximate a top of said cone.

14. The assembly according to claim 13, further comprising said control panel being electrically coupled to said processor wherein said control panel selectively actuates said processor.

15. The assembly according to claim 1, further comprising:

an actuator coupled to a front of said control panel;

said actuator being electrically coupled to said processor wherein said actuator selectively actuates said processor; and said actuator being one of a plurality of said actuators, each of said plurality of actuators performing a selected one of a plurality of command functions.

16. The assembly according to claim 1, further comprising:

a power supply coupled to said cone;

said power supply being electrically coupled to said processor; and said power supply comprising at least one battery.

17. A motion detecting traffic cone assembly comprising:

a cone being positionable proximate a hazard wherein said cone is configured to alert an observer to the hazard, said cone having a plurality of sides wherein said cone has a pyramidal shape;

a processor coupled to said cone;

a motion detector coupled to a front side of said cone wherein said motion detector faces away from the hazard wherein said motion detector is configured to detect the observer, said motion detector being electrically coupled to said processor wherein said motion detector selectively actuates said processor;

a light emitter coupled to a top of said cone wherein said light emitter comprises a frustum of said cone, said light emitter being electrically coupled to said processor wherein said processor selectively actuates said light emitter, said light emitter emitting a beam of light wherein said light emitter is configured to alert the observer of the hazard, said light emitter being one of a plurality of said light emitters, said plurality of light emitters being evenly distributed around a plurality of sides of said cone;

an alarm coupled to said cone, said alarm being electrically coupled to said processor wherein said alarm selectively generates an alarm signal;

a speaker coupled to a rear side of said cone wherein said speaker emits an audible warning, said speaker being electrically coupled to said alarm wherein said speaker emits the audible warning when said alarm generates the alarm signal;

a control panel coupled to a rear side of said cone proximate a top of said cone, said control panel being electrically coupled to said processor wherein said control panel selectively actuates said processor;

an actuator coupled to a front of said control panel, said actuator being electrically coupled to said processor wherein said actuator selectively actuates said processor, said actuator being one of a plurality of said actuators, each of said plurality of actuators performing a selected one of a plurality of command functions; and a power supply coupled to said cone, said power supply being electrically coupled to said processor, said power supply comprising at least one battery.

* * * * *